United States Patent [19]

Kane et al.

[11] Patent Number: 4,583,309

[45] Date of Patent: Apr. 22, 1986

[54] TAMPER-PROOF DISPLAY ASSEMBLY

[75] Inventors: Michael N. Kane, River Forest; Lawrence R. Hogan, Lake Villa, both of Ill.

[73] Assignee: Kane Graphical Corporation, Chicago, Ill.

[21] Appl. No.: 642,836

[22] Filed: Aug. 21, 1984

[51] Int. Cl.[4] ..... G09F 1/12

[52] U.S. Cl. ..... 40/152; 40/152.1

[58] Field of Search ..... 40/600, 152, 152.1; 15/235.4, 236 R

[56] References Cited

U.S. PATENT DOCUMENTS

| | | | |
|---|---|---|---|
| 2,088,672 | 8/1937 | Steinthal | 40/152 |
| 2,828,502 | 4/1958 | Tupper | 15/236 |
| 3,611,604 | 10/1971 | Saltzman | 40/152 |
| 3,787,992 | 1/1974 | Leonhardt | 40/152 |
| 3,885,336 | 5/1975 | Olsen | 40/152 |
| 4,467,543 | 8/1984 | Townsend | 40/152 |

FOREIGN PATENT DOCUMENTS

| | | | |
|---|---|---|---|
| 463503 | 3/1950 | Canada | 15/236 R |
| 2021945 | 12/1979 | United Kingdom | 40/152 |

*Primary Examiner*—Robert Peshock
*Assistant Examiner*—Cary E. Stone
*Attorney, Agent, or Firm*—Russell E. Hattis; Stephen R. Arnold

[57] ABSTRACT

A display assembly for posters or signs includes a cover frame having a clear sealed window at the front surface thereof. The display assembly is generally rectangular, the cover frame having four outwardly facing walls configured to slide into forwardly extending closely fitting walls extending from a one piece wall-mountable shroud-forming frame. Magnetic strips affixed to interior faces of the shroud-forming frame capture and hold an inserted cover frame, and the closely fitting shroud walls and immediately confronting cover frame walls serve to defeat the insertion of conventional tools to remove the cover when so emplaced. A special spatulate tool is configured with projections stressed to spring out of the plane of the blade in the relaxed state. The extensions are temporarily pressed flat during insertion, to spring outward when inserted to maximum depth into the assembly, the extensions when thus deployed confronting and engaging a rear portion of the cover frame. Withdrawal of the tool causes withdrawal of the cover frame for replacement of the contents.

24 Claims, 11 Drawing Figures

FIG. 1
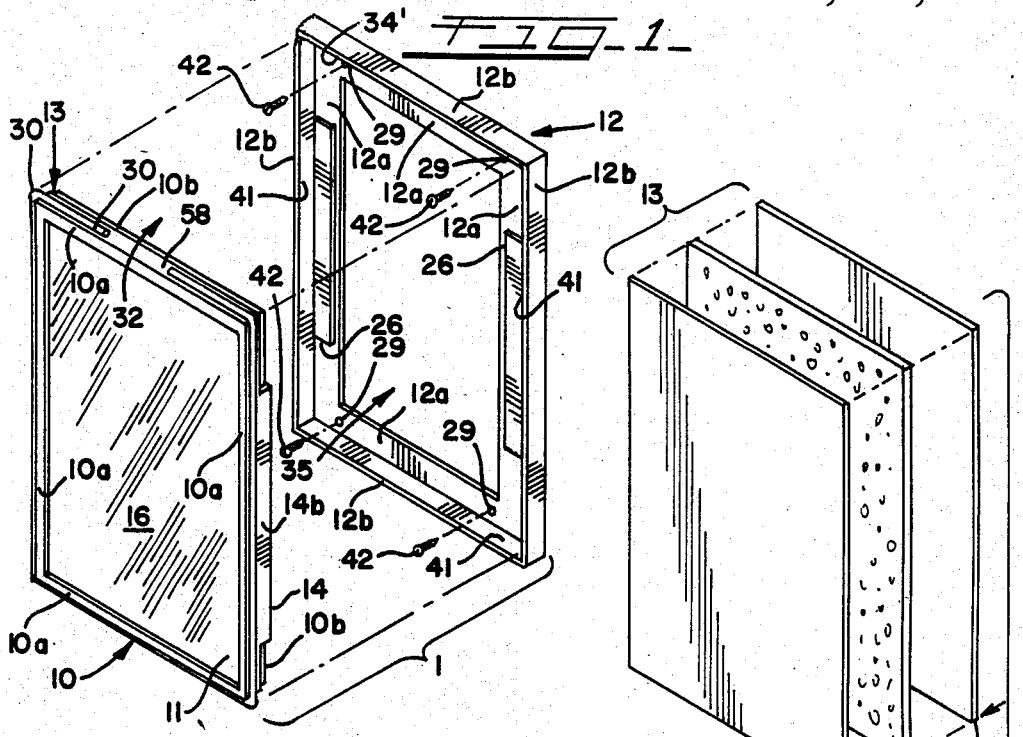
FIG. 2
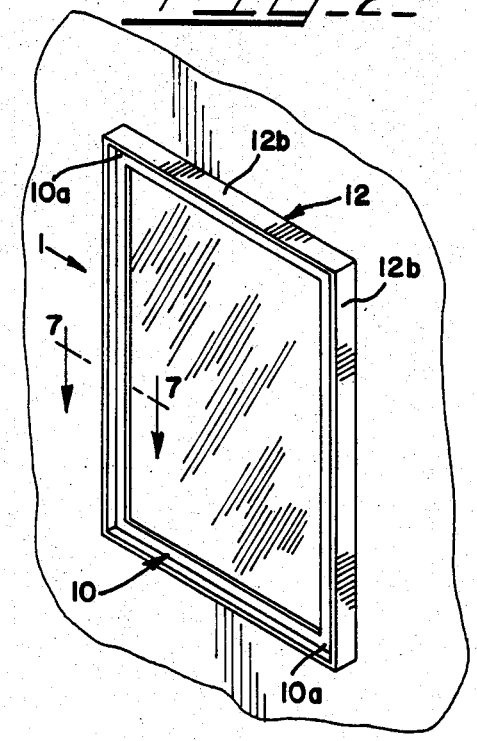
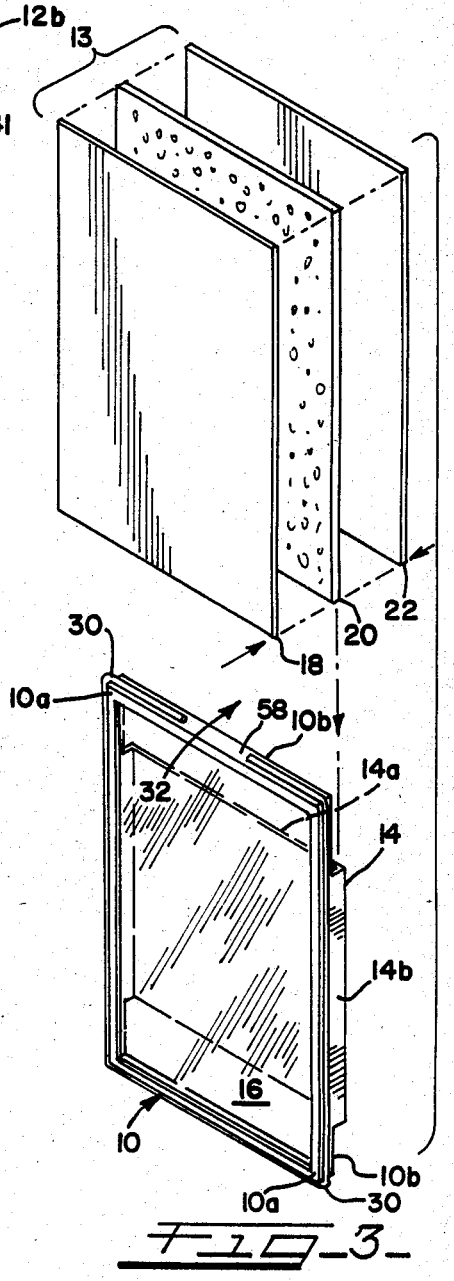
FIG. 3

TAMPER-PROOF DISPLAY ASSEMBLY

TECHNICAL FIELD OF THE INVENTION

The technical field of the invention is the display art, and in particular outdoor poster display sign assemblies designed to be tamper-proof and weather proof.

BACKGROUND OF INVENTION

It is commonly experienced that posters or signs are frequently defaced, obliterated, or removed by vandals. Such vandalism cannot effectively be prevented simply by enclosing the poster or sign within a frame having a transparent window and fitted together by conventional fastening means, e.g. screws, since vandals frequently employ commonly available hand tools such as screwdrivers to gain access to the poster or sign inside. Moreover, a problem is presented to the designer of such units in that, not only must they be tamper-proof with respect to vandals, but on the other hand it is necessary that it be a relatively simple matter for untrained personnel to remove the old poster from the display housing and replace it with a new one.

Thus, a tamper-proof display assembly desirably should satisfy the paradoxical requirements of defeating a skilled vandal using conventional readily available tools on the one hand, and be readily accessible to completely unskilled personnel for purposes of poster replacement. Additionally, such a sign assembly should be quite inexpensive to fabricate, and further be configured to provide adequate protection to the display contents, e.g. a poster, against the elements, when placed in outdoor locations. Although a key-lockable pivoted transparent door covering a sign-containing open front box-like structure may be employed for such purposes, such assemblies are costly, and the locks are readily susceptible to freezing in cold weather.

To the applicant's knowledge, prior to the present invention as disclosed herein, no satisfactory solution to the above mentioned problems have been heretofore developed.

SUMMARY OF INVENTION

A weather-sealed tamper-proof display assembly designed to accept two-dimensional articles, e.g. posters and display signs, comprises two major components held to each other by preferably magnetic holding means and separable from each other by use of a specially configured tool. These two major components in the preferred form of the invention include a generally rectangular wall-mountable rear shroud-forming component having forwardly extending walls forming a rectangular insertion aperture, and a front rectangular cover frame having a generally centrally disposed transparent viewing window sealingly affixed therebehind. While in accordance with the broadest aspect of the invention the shroud could be designed to receive the display sign or poster involved, the cover frame preferably is designed to receive the same. In the preferred form of the invention, a sign or poster-retaining means is affixed to the rear of the cover frame between two opposing sides thereof and preferably provides an insertion channel or pocket behind the viewing window. Into this pocket is slid an assembly preferably comprising a sign or poster and suitable backing sheets therebehind, to be captively retained in position behind the window by the retaining means. The inserted assembly preferably includes a compressible sheet shuch as polyurethane foam and a rigid backing board to press the poster of sign flat against the window. This materially assists in preventing wrinkling of the poster or sign under high humidity conditions.

Attached to the cover frame are frame holding means preferably configured to present rearwardly facing surfaces to confront complementary forwardly facing surfaces of holding means on the periphery of the shroud-forming frame when the cover frame is slidingly inserted into the insertion aperture thereof. These holding means are preferably magnetic means. Thus, while these holding means could be spring urged holding means or Velcro (Trademark) holding means, or the like, the use of magnetic means to be described is decidedly preferred for cost and reliability reasons.

In accordance with another feature of the invention, weather sealing strip means may be mounted on confronting peripheral faces of these front and rear display components to provide a seal against the elements.

According to a more specific aspect of the invention, one of the magnetic holding means is the ferromagnetic material of one of the components, and the complementary holding means are magnetized strips permanently bonded to the periphery of the other component so that the inserted cover frame component captively locked in the insertion aperture of the rear shroud-forming component by the magnetic force of the strips.

Independently of whether the holding means are on forwardly and rearwardly facing surfaces of the frame component, along at least one side of these components is a narrow gap therebetween which permits insertion of a special tool to be described. The clearances between the cover frame and shroud-forming frame are so small that a conventional tool such as a screwdriver cannot be inserted therein to pry the frame loose from the force of the holding means. This tamper-proof feature is further augmented by configuring the shroud walls to extend forwardly substantially beyond the front face of the inserted cover frame, thereby further inhibiting such tool access, and also providing increased protection against the elements. Further, to prevent theft of the entire assembly, the attachment means for mounting the shroud on a chosen wall are emplaced and affixed to interior portions of the shroud, so that an emplaced frame completely covers these means.

According to a most important further feature of the invention, the specially configured tool of the invention is preferably a resilient metal blade or spatula affixed to a handle, the tool preferably appearing like a paint scraper. Arcuate cutouts provided near the distal end of the blade leave two laterally extending fingers at the end of the blade. These fingers are pre-stressed or deformed so that they project in the same direction out of the plane of the blade. Because of the resiliency of the blade material, when the blade is inserted into the gap between the shroud and the cover frame these fingers are cammed into a coplanar relationship with the remainder of the blade to allow insertion deeply into the assembled structure, whereupon they spring out of this plane to confront rear portions of the cover frame. A simple pull on this tool then breaks the magnetic seal and allows the frame to be withdrawn. The structure, because of its simplicity, is substantially less expensive than structures employing conventional keys and lock assemblies, and is substantially immune to low temperature freezing of the release mechanism.

The entire structure is most preferably fabricated from simple angle stock and sheet metal stock by welding to provide an inexpensive weather-proof and highly tamper resistant sign or poster display assembly characterized by minimal fabrication costs. No external apertures, angles, or similar attachment points are presented whereby a vandal using conventional tools may gain access to the poster, or alternatively remove the entire assembly from the wall.

The above and other features and advantages of the invention will become apparent upon making reference to the specification to follow, the claims and the drawings.

DESCRIPTION OF DRAWINGS

FIG. 1 is a perspective view of a display frame assembly having a poster and backing sheets inserted into a channel of the frame behind a window of a cover frame, the frame being positioned for insertion into a closely fitting rectangular wall-mountable shroud.

FIG. 2 is a perspective view of the display frame assembly of FIG. 1 captively inserted into the shroud, with the shroud mounted on a wall.

FIG. 3 is a perspective view showing an empty display frame with the transparent cover frame mounted therein, and further showing in exploded form the poster and backing sheets to be inserted into the channel of the cover frame.

DETAILED DESCRIPTION OF THE PREFERRED FORM OF THE INVENTION

Figure 4:
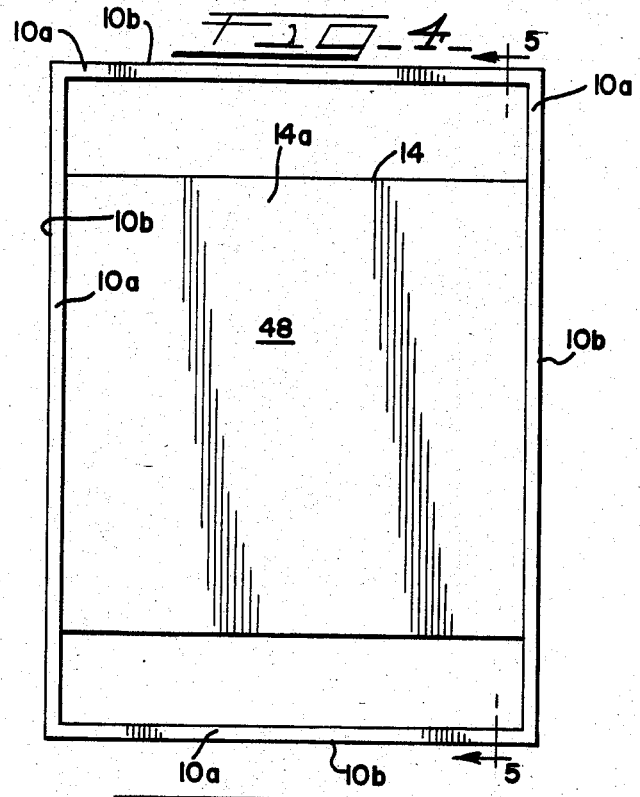
FIG. 4 is a front elevation of the empty cover frame of FIG. 3.
Figure 5:
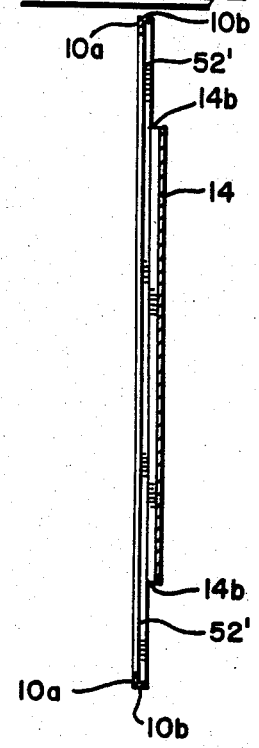
FIG. 5 is a side cross sectional view of the cover frame of FIG. 4, taken along section lines 5—5 therein.
Figure 6:
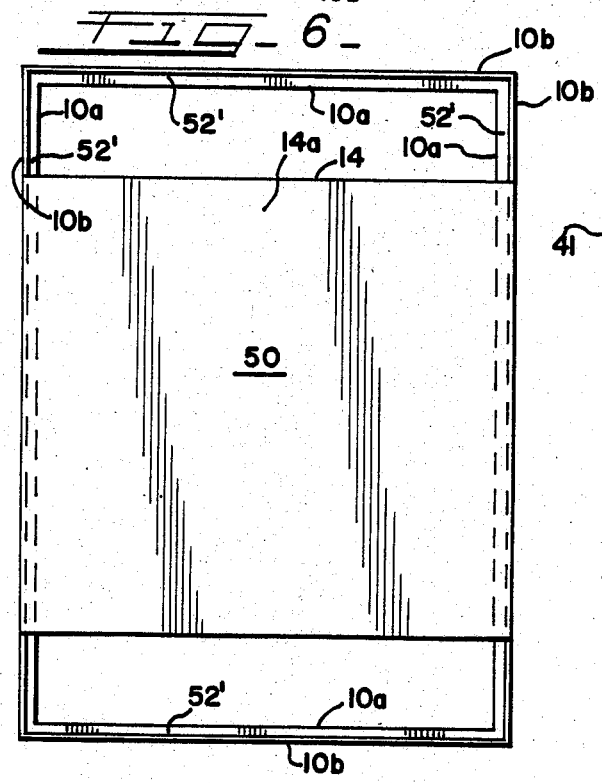
FIG. 6 is a rear elevational view of the cover frame of FIG. 4.

FIGS. 1 and 2 show the overall aspects of a tamper-proof display assembly 1 adapted for mounting on a vertical wall. The two principal components of the display assembly 1 are a cover frame 10 and an enclosing shroud-forming frame 12. The cover frame 10 as illustrated is formed from angle bar stock to present top, bottom and side vertical peripheral walls 10*a* defining a viewing opening 11 and rearwardly expending flanges 10*b*. There is sealedly affixed to the interior (rear) peripheral surfaces of the vertical walls 10*a* a transparent panel 16 of a suitable material such as acrylic plastic.

Behind this window 16 are a sandwich 13 of sheets including (See FIG. 3) a two-dimensional article in the form of poster 18 or sign sheet to be viewed through the pane 16, the poster or sign sheet in turn having emplaced therebehind a rectangular compressible sheet 20 made of a suitable material such as polyurethane foam. Behind the compressible sheet 20 is a rigid thin rectangular backing sheet or board 22. The poster or sign sheet 18, the compressible sheet 20 and the backing board 22 are held together as a sandwich and slid into position behind the sealed-in pane 16 to be compressingly held there by a generally U-shaped channel-forming member 14 attached by welding to the rear edges of the flanges 10*b* of the cover frame 10. Thus, the pocket-forming member 14 has a main rear laterally extending vertical wall 14*a* and side flanges 14*b* welded to the rear edges of cover frame flanges 10*b*. The member 14 occupies only the mid-region of the cover frame and forms an accessible upwardly facing channel opening between it and the pane 16 so that the sandwich 13 of sheets can be easily inserted into this opening. The initial thickness of the sheet sandwich 13 is greater than the spacing between wall 14*a* and pane 16 so that the sheet 20 is compressed to resiliently sandwich these sheets, which fit just within the confines of the cover frame walls 10*a*, between the wall 14*a* and the pane 16. By this means the poster or sign sheet 18 is pressed flat against the window. This materially assists in preventing wrinkling of the poster or sign under high humidity conditions.

A compressible sealing strip 30 is disposed along the outer faces 58 of the cover frame flanges 10*b*. A gap 32, preferably centrally located in the sealing strip 30 at the top of the cover frame 10 is provided to allow for insertion of a specially configured tool 62 (FIGS. 9 and 10) which allows removal of the cover frame from the shroud-forming frame 12 into which the cover frame is pressingly inserted.

The shroud-forming frame 12 is shown as generally rectangular frame formed from angle bar stock and presenting rear vertical walls 12*a* at the top, bottom and sides thereof and forwardly projecting flanges 12*b* defining within them an insertion aperture or recess 35 which fairly closely receives the cover frame 10. The shroud-forming frame 12 is dimensioned such that when the cover frame 10 is pressingly inserted into the shroud-forming frame 12, the sealing strip 30 is compressed into sealing engagement between the outwardly facing sealing strip-carrying faces 10*b* to the inner faces 41 of the flanges 12*b* of the shroud-forming frame 12.

For reasons that will shortly become evident, in order to render the inserted cover frame 10 shown in FIG. 2 non-removable from the shroud-forming frame 12 by conventional tools, the spacing between the confronting interior faces 41 of the peripheral flanges 10*b* and 12*b* should be no greater than 1/16 inches. The forward-facing vertical walls 12*a* of the shroud-forming frame 12 are provided with-four holes 29 for accepting screws 42 passing through these walls for securing the shroud-forming frame 12 to a wall.

In addition to the frictional engagement provided by the sealing strip 30 when the cover frame 10 is inserted into the closely fitting shroud-forming frame 12, there is provided a more secure cover frame holding means on the front faces of the side vertical walls 12*a* of the frame 12. These holding means are preferably a pair of strips 26—26 of permanently magnetized material. The strips are permanently affixed, as for example by epoxy adhesive or other permanent adhering means. When the cover frame 10 is inserted into the shroud-forming frame 12, the rear face 50 of the pocket-forming member 14 on cover frame 10 comes into contact with these magnetic strips 26—26 to provide a magnetic attraction holding the cover frame and the shroud-forming frame securely together. Preferably, both the cover frame 10 and its pocket-forming member 14 are thus made of a ferromagnetic material, such as ferromagnetic type stainless steel. By this means, a strong magnetic retention is secured, and the known weather proof properties of such stainless steel may be used to maximum advantage against the elements. It will be noted with respect to FIG. 1, and more particularly with respect to the partial section view of FIG. 7 (to be discussed) the flanges 12*b* of the shroud-forming frame 12 extend forwardly beyond the inserted cover frame 10 to provide an additional protection against rain, and also to make the display assembly more tamper-proof.

Figure 7:
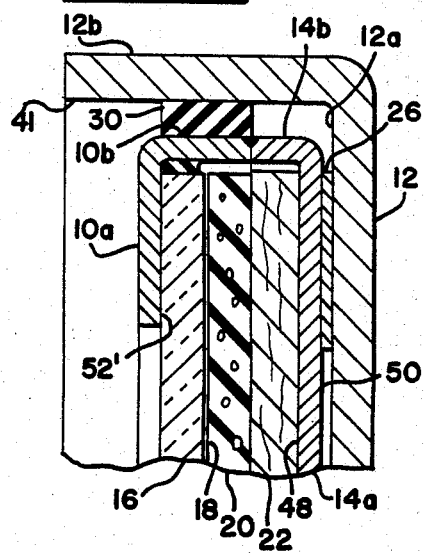
FIG. 7 is a partial horizontal cross section view of the assembly shown in FIG. 2, taken along section lines 7—7 therein.

FIG. 7 best shows the details of the display assembly of the invention. Here it will be seen that the planar rear face 50 of the pocket-forming member 14 is in planar engagement with a magnetic strip 26. This strip may be affixed as by a suitable adhesive means to the vertical peripheral wall 12*a* of the shroud-forming frame 12. By proper choice of length, thickness, and magnetization of the strips 26—26, the cover frame 10 shown in FIG. 2 may be secured with sufficient anchoring force that it cannot be readily removed by means of ordinary tools in the hands of skilled vandals.

Further to providing a tamper-proof feature, the clear window pane 16 may be permanently secured to the rear surface 52′ of the peripheral vertical walls 10*a* of the cover frame 10 by adhesive means, such as room temperature vulcanizing silicone rubber, the pane 16 being thus held in tight engagement with this rear surface 52′ to prevent insertion of a tool between the pane 16 and the rear surface 52′ of a vertical wall 10*a* of the cover frame, thereby preventing a vandal from extracting the cover frame 16 from the shroud-forming frame 12. FIG. 7 also shows in cross section the capture of a poster 18 between the pane 16 and the compressible sheet 20 and the rigid backing board 22, this sandwich being held captive by the forward face 48 of the vertical wall 14*a* of the pocket-forming member 14. Thus, it is apparent that a generally weather-tight display assembly is provided which cannot readily be vandalized because of the previously mentioned tight clearances around the periphery of the cover frame 10, and because no grasping points or attachment points are provided whereby a skilled vandal having ordinary tools can quickly remove either the cover frame 10 from the shroud-forming frame 12, or alternatively the poster 18 from the cover frame.

Figure 8:
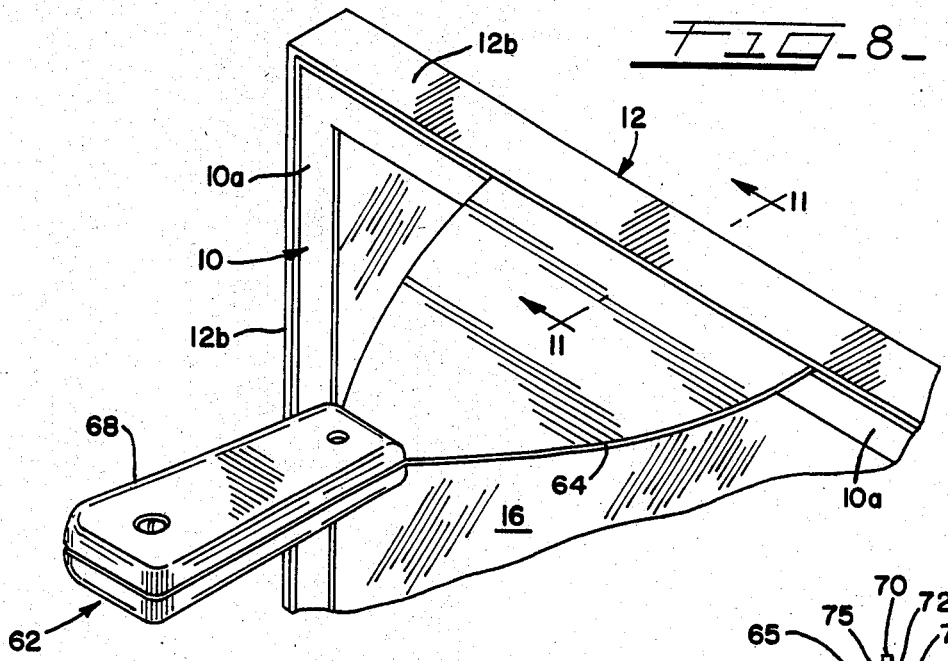
FIG. 8 is a perspective view of the assembly shown in FIG. 2 showing a specially configured tool inserted for removal of the cover frame from the shroud.
Figure 9:
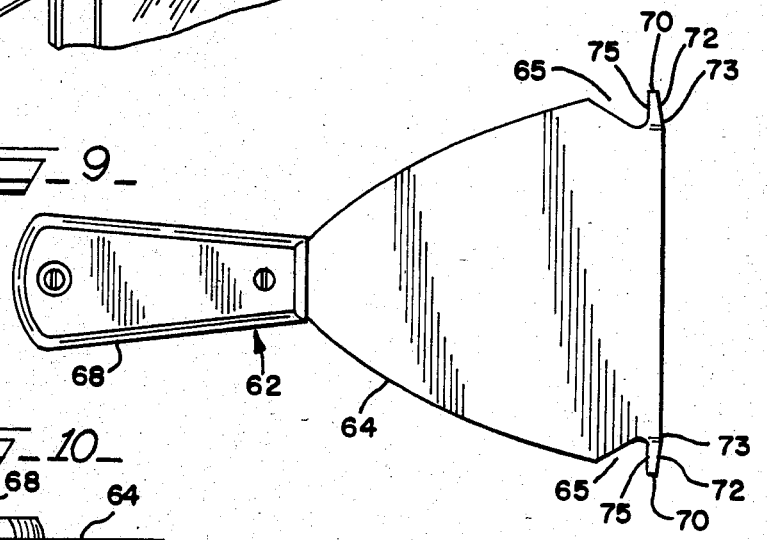
FIG. 9 is a plan view of the tool of FIG. 8.
Figure 10:
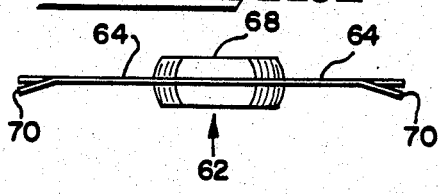
FIG. 10 is an end view of the tool of FIG. 8.

FIGS. 9 and 10 show views of a frame removal tool 62 designed for insertion as shown in FIG. 8 through the gap 32 in the sealing strip 30 between the upper face 58 of the cover frame 10 and the confronting interior surface 34′ of the top flange 12*b* of shroud-forming frame 12. In the preferred form of the invention, the tool 62 is fabricated by modifying a spatula paint scraper having a handle 68 and a blade 64 of highly flexible material. This spatula tool 62 is configured with a pair of inwardly extending cut-outs 65 proximate to the distal end of the blade 64 and locally reducing the span of the blade 64 immediately proximate to the end thereof. The remaining outwardly extending portions or extensions 70 of the blade 64 are further configured with leading shoulders 72 extending from leading points 73 approximately opposite the maximum inward encroachment of the cut-outs 65 to sweep back moderately to the ends of the extensions 70. Further, the extensions 70 are bent in the same direction and out of the general plane of the blade 64 as shown in FIG. 10. These extensions are thus flexible members having generally transversely extending rearwardly facing shoulders 75 disposed in their relaxed state out of the general plane of the blade 64.

Figure 11:
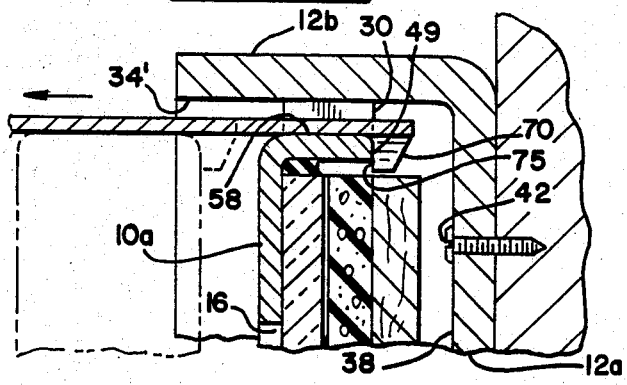
FIG. 11 is a cross section side detailed view of a portion of the inserted tool shown in FIG. 8, taken along section lines 11—11 thereof and illustrating details of the tool engagement with a rear portion of the inserted cover frame.

As shown in FIG. 8, such a tool may readily be inserted between the upper face 58 of the cover frame 10 and the confronting surface 34′ of the upper horizontal wall 12*b*. The cover frame 10 is here shown slightly withdrawn from the shroud-forming frame 12. FIG. 11 shows a cross section partial detail view of the tool so inserted. It will be noted that when the blade 64 is inserted as shown, the extensions 70 automatically encounter an unobstructed region wherein they can spring out of the common plane of the blade 64 to reside in an extended position behind the rearmost portion of the upper flange 12*b* of the cover frame 12. This unobstructed region arises from the fact that the poster 18, the compressible sheet 20, and the backing board 22 are configured slightly undersize with respect to the general confines of the cover frame 10 so that the upper ends thereof lie slightly below the rearmost portion 49 of the upper flange 10*b* of the cover frame 10. Thus, an inserted tool of the type described herein may be inserted to engage the rearmost portion 49 of the cover frame 10 at the top thereof. An outward pulling force thereafter applied to the handle 68 of the tool 62 can apply sufficient force to break the securing magnetic attraction between the magnetic strips 26 and the rear face 50 of the pocket-forming member 14, extracting the frame as indicated by the dotted lines in FIG. 11.

It will be noted that, because of the rather substantial force necessary to break the magnetic bond, and because of the closely fitting relationship between the confronting portions of the cover frame 10 and shroud-forming frame 12, the employment of conventional tools, short of actually cutting into portions of the assembly, is not likely to be successful in removing the cover frame 10. Thus, an inserted screwdriver blade employed by a vandal and forced between the outer margins of the cover frame 10 and the inner margins of the shroud-forming frame 12, and which is thin enough to fully enter the passage therebetween would not be strong enough to eject the frame by an upward prying movement. Conversely, a screwdriver massive enough to supply such a force would be too thick to secure adequate depth of entry. Since in the preferred form of the invention, as previously mentioned, the pane 16 is permanently secured in place, a prying or hooking engagement of any conventional tool with the front of the cover frame 10 or its associated frontal margins is similarly precluded.

On the other hand, no mechanical skill whatever is necessary to the possessor of the tool 62, which by a simple insertion and withdrawal action readily removes the cover frame 10. It is further to be noted that the mounting screws 42 holding the shroud-forming frame 12 to its chosen supporting wall are inaccessible to the vandal, since they are completely covered by a cover frame 10. Also, since all elements of the structure are secured by a permanent means such as welding, there are no convenient externally accessible screws providing a vandal with a means to remove a portion of the assembly to obtain access thereinto. It will further be noted that there is no requirement whatever for complex mechanical linkages, e.g. key-actuated locks, to secure the tamper-proof feature, resulting in a structure that is characterized by a low manufacturing cost and reliability of operation, while further providing an adequate degree of protection of the interior of the display frame assembly 10 against the elements.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out the invention, but that the invention will include all embodiments falling within the scope of the appended claims.

Thus, for example, the central concepts of the present invention are not necessarily restricted to a rectangular structure. It is quite clear that the shroud-forming frame and cover frame could be configured with matching arcuate surfaces, the only requirement being that the insertion point for the tool must be located at a point where the radius of any such arc is sufficiently great that the tool can be inserted without causing permanent deformation thereof.

Additionally, alternative forms of holding means may be employed to hold the cover frame in the shroud. These may, for example, take the form of spring-loaded balls on one unit and matching detents on the other. Alternatively confrontingly opposed strips of locking-bristle fabric such a Velcro (Trademark) may be employed. All that is required is that the holding means be adequately strong to resist conventional prying tools, and be substantially immune to erratic operation in freezing weather.

We claim:

1. A display assembly for accepting a sign or poster sheet or the like for the display thereof comprising:

a shroud-forming frame including attachment means for attaching said shroud-forming frame to a vertical mounting surface, said shroud-forming frame having peripheral walls forwardly extending from forwardly facing vertical surfaces interior to said peripheral walls, said peripheral walls defining an insertion aperture into said shroud-forming frame from the front thereof;

a cover frame having peripheral margins presenting outwardly facing surfaces configured for closely confronting nesting relationship with the interior surfaces of said peripheral walls of said shroud-forming upon insertion of said cover frame into said insertion aperture, said cover frame having rearwardly facing vertical surfaces and a sealed transparent forwardly facing viewing portion forming a window through which a sign or poster sheet behind the same is visible;

retaining means for accepting and holding a poster or sign sheet behind said window;

one of said cover frame and said shroud-forming frame including a first holding means, the other of same including second holding means releasably engaging said first holding means, said first and second holding means being disposed within said assembly to provide a force operating to hold said cover frame in said shroud-forming frame when inserted therein so that said shroud-forming frame completely surrounds the sides of said inserted cover frame to prevent direct access to the rear surfaces of said cover frame, said cover frame and shroud-forming frame being configured to provide a first tool-receiving forwardly opening narrow gap between the confronting portions of said outwardly facing surfaces of said cover frame and said interior surfaces of said peripheral walls of said shroud-forming frame.

2. The display assembly of claim 1 wherein said retaining means is part of said cover frame.

3. The display assembly of claim 1 wherein said holding means on said shroud-forming frame is disposed on on one or more of said forwardly facing vertical surfaces thereof and said holding means on said cover frame is disposed on one or more of said rearwardly facing vertical surfaces thereof.

4. The display assembly of claim 1 wherein said cover frame is provided with at least one rearwardly facing surface immediately adjacent at least one of said outwardly facing surfaces thereof and disposed at a standoff distance from said forwardly facing vertical surfaces of said shroud-forming frame with said cover frame inserted so as to provide engaging surfaces in an unobstructed region for engagement with one or more deployable blades of a generally planar cover frame extraction tool configured to enteringly pass through said first narrow gap, and further combined with said extraction tool, said tool comprising:

a handle at the proximal end of said tool; and a resilient blade affixed to said handle and configured with at least one springingly deformable portion at the distal end thereof, said deformable portion being urgeable by insertion of said tool into said gap into a generally coplanar relationship with the remainder of said blade and springing out of said relationship when within said standoff distance and confrontingly to engage at least one of said rearwardly facing faces of said cover frame for withdrawal of said cover frame for said shroud-forming frame.

5. The display assembly of claim 1 combined with a tool comprising: a handle at the proximal end of said tool, a resilient blade affixed to said handle and configured with at least one springingly deformable portion at the distal end thereof, said deformable portion being urgeable by insertion of said tool into said gap into a generally coplanar relationship with the remainder of said blade and springing out of said relationship to deploy and engage a peripheral side of said cover frame for withdrawal of said cover frame from said shroud-forming frame, and said assembly provides an unobstructed region immediately behind the portion of said peripheral wall of said cover frame to be engaged, and said at least one deformable portion of said tool is configured to present when deployed after insertion an outwardly facing shoulder confronting the interior end of said peripheral wall.

6. The display assembly of claim 1 wherein there is further provided compressible weather-sealing means disposed along said outwardly facing surfaces of said cover frame for resiliently engaging said interior surfaces of said peripheral walls of said shroud-forming frame.

7. The display assembly of claim 6 wherein a second tool-receiving gap is formed in said weather-sealing means to allow insertion of said tool.

8. The display assembly of claim 7 combined with said tool.

9. The combination of claim 4, 5, or 8 wherein said blade is configured as a spatula having a generally increasing breadth towards the distal end thereof, and a pair of said deformable portions are formed by providing inwardly extending cutouts in said blade proximate to a transversely disposed generally linear distal blade end.

10. The display assembly of claim 7 wherein said second tool-receiving gap extends along only a limited portion one side of the confronting peripheral walls of said frames.

11. The display assembly of claim 1 wherein said attachment means includes fastening means for fastening said shroud-forming frame to said vertical surface and accessible only when said cover frame is removed.

12. The display assembly of claim 11 wherein said shroud-forming frame includes generally vertical planar backing walls extending transversely from the rear of said forwardly extending peripheral walls to define the rear of said insertion aperture, and said fastening means includes at least one fastener-accepting hole passing through one of said forwardly facing vertical surfaces of said shroud-forming frame and accessible from the front of said shroud-forming frame only through said insertion aperture.

13. The display assembly of claim 1 wherein said forwardly extending peripheral shroud forming forward walls are configured to extend forward beyond the margins of said cover frame when fully inserted therein.

14. The display assembly of claim 1 wherein said forwardly extending peripheral walls of said shroud-forming frame form a rectangular insertion aperture and said cover frame is generally rectangular having outwardly facing peripheral margins closely fitting into said insertion aperture.

15. The display assembly of claim 1 wherein said sealed transparent portion of said cover frame is a planar sheet permanently secured to the margins of an aperture in said cover frame.

16. The display assembly of claim 15 wherein said retaining means includes a retaining member secured to the rear of said cover frame at a standoff distance from and parallel to the rear face of said transparent sheet to provide therebetween space for insertingly accepting a display poster or sign therebetween.

17. The display assembly of claim 16 wherein said display assembly further includes a compliant compressible sheet configured for sliding insertion along with a poster into said space to be compressingly frictionally retained as a sandwich therein by said retaining means.

18. The display assembly of claim 1 wherein said first holding means and said second holding means include at least a pair of ferromagnetic members, at least one of which is permanently magnetized.

19. The display assembly of claim 18 wherein said holding means on one of said frames includes at least one magnetized strip disposed on one or more vertical surfaces thereof and said holding means on the other of same includes at least one magnetizable surface on the latter frame and disposed to face and contactingly engage said at least one magnetized strip.

20. The display assembly of claim 19 wherein said sealed transparent portion of said cover frame is a planar sheet permanently secured to the margins of an aperture in said cover frame and said retaining means includes a planar retaining member secured to the rear of said cover frame at a standoff distance from and parallel to the rear face of said transparent pane to provide therebetween space for insertingly accepting a display poster or sign therebetween, and said at least one magnetized strip is disposed on said forwardly facing vertical surface of said shroud-forming frame to confrontingly contact the rear surface of said retaining member when said cover frame is inserted into said shroud-forming frame, and wherein at least said retaining member is made of ferromagnetic material.

21. A frame removal tool for a display sign assembly, said assembly including a cover frame and a shroud-forming frame having means for mounting said shroud-forming frame on a vertical surface, said shroud-forming frame including attachment means for attaching said shroud-forming frame to a vertical surface and having forwardly extending peripheral walls defining an insertion aperture into said shroud-forming frame from the front thereof, said cover frame having peripheral margins presenting outwardly facing surfaces configured for closely confronting nesting relationship with the interior surfaces of said peripheral walls of said shroud-forming frame upon insertion of said cover frame having a forwardly facing viewing and sealing window through which a sign or poster sheet behind the same is visible, said display assembly including holding means disposed within said assembly to provide a force operating to hold said cover frame in said shroud-forming frame when inserted therein, said shroud-forming frame completely and closely surrounding the sides of said inserted cover frame so that said shroud-forming frame completely surrounds the sides of said inserted cover frame to prevent direct access to the rear surfaces of said cover frame, said cover frame and shroud-forming frame being configured to provide a forwardly opening narrow gap between a portion of the interior surface of one of said shroud walls, and the confronting peripheral surface of said frame, said tool comprising:

a handle at the proximal end of said tool; and a spatulate resilient blade affixed to said handle and configured with at least one springingly deformable portion at the distal end thereof, said deformable portion being urgeable by insertion of said tool into said gap into a generally coplanar relationship with the remainder of said blade and springing out of said relationship to deploy and engage a peripheral side of said frame for withdrawal of said frame from said shroud.

22. The frame removal tool of claim 21 wherein there is provided in said assembly an unobstructed region immediately behind said peripheral side member to be engaged, and said at least one deformable portion of said tool is configured to present when deployed after insertion a forwardly facing shoulder confronting the interior end of said peripheral side.

23. The frame removal tool of claim 22 wherein said blade is configured as a spatula having a generally increasing breadth towards the distal end thereof, and a pair of said deformable portions are formed by providing inwardly extending cutouts in said blade proximate to a transversely disposed generally linear distal blade end.

24. The frame removal tool of claims 21, 22, or 23 and wherein said attachment means are disposed to be inaccessibly covered by an inserted cover frame.

* * * * *